US011781733B2

(12) United States Patent
Qiu et al.

(10) Patent No.: US 11,781,733 B2
(45) Date of Patent: Oct. 10, 2023

(54) VEHICLE LAMP OPTICAL ELEMENT, VEHICLE LAMP MODULE, VEHICLE HEADLAMP AND VEHICLE

(71) Applicant: HASCO VISION TECHNOLOGY CO., LTD., Shanghai (CN)

(72) Inventors: Zhiping Qiu, Shanghai (CN); Dapan Zhang, Shanghai (CN); He Zhu, Shanghai (CN); Wenhui Sang, Shanghai (CN)

(73) Assignee: HASCO VISION TECHNOLOGY CO., LTD., Shanghai (CN)

( * ) Notice: Subject to any disclaimer, the term of this patent is extended or adjusted under 35 U.S.C. 154(b) by 147 days.

(21) Appl. No.: 17/607,570

(22) PCT Filed: May 21, 2020

(86) PCT No.: PCT/CN2020/091591
§ 371 (c)(1),
(2) Date: Oct. 29, 2021

(87) PCT Pub. No.: WO2020/244391
PCT Pub. Date: Dec. 10, 2020

(65) Prior Publication Data

US 2022/0243893 A1 Aug. 4, 2022

(30) Foreign Application Priority Data

Jun. 5, 2019 (CN) ..... 201910488336.X
Aug. 8, 2019 (CN) ..... 201910730411.9
Aug. 22, 2019 (CN) ..... 201910780214.8

(51) Int. Cl.
*F21V 5/04* (2006.01)
*F21S 41/36* (2018.01)
(Continued)

(52) U.S. Cl.
CPC ..... *F21V 5/04* (2013.01); *F21S 41/153* (2018.01); *F21S 41/255* (2018.01); *F21S 41/36* (2018.01);
(Continued)

(58) Field of Classification Search
CPC ... F21V 5/04; F21S 41/36; F21S 41/27; F21S 41/322; F21S 41/365; F21S 41/663; F21S 43/241
See application file for complete search history.

(56) References Cited

U.S. PATENT DOCUMENTS 10,139,646 B2 * 11/2018 Gromfeld ..... F21S 41/365
10,145,527 B2 12/2018 Lee et al.
(Continued)

FOREIGN PATENT DOCUMENTS

CN 101761849 A 6/2010
CN 103890484 A 6/2014
(Continued)

*Primary Examiner* — Tracie Y Green
*Assistant Examiner* — Michael Chiang
(74) *Attorney, Agent, or Firm* — Volpe Koenig

(57) ABSTRACT

Disclosed are a vehicle lamp optical element, a vehicle lamp module comprising the vehicle lamp optical element, a vehicle headlamp, and a vehicle. The vehicle lamp optical element comprises a light incoming part, a transmission part and a light exiting part, which are sequentially arranged. The light incoming part includes at least one light incoming structure. The rear end and the front end, in a light exiting direction, of the transmission part are respectively a light incoming end and a light exiting end of the transmission part. One end, facing away from the light exiting end of the light exiting part forms a light exiting face. The light exiting face is a curved face protruding forwards. The distance between at least one set of opposite side faces of the transmission part gradually increases from the end
(Continued)

approaching the light incoming end to the end approaching the light exiting end.

17 Claims, 11 Drawing Sheets

(51) Int. Cl.

| | |
|---|---|
| ***F21S 41/255*** | (2018.01) |
| ***F21S 41/153*** | (2018.01) |
| *F21Y 115/10* | (2016.01) |
| *F21S 41/16* | (2018.01) |
| *F21S 43/249* | (2018.01) |
| *F21S 41/151* | (2018.01) |
| *F21S 41/663* | (2018.01) |

(52) U.S. Cl.
CPC ..... *F21S 41/151* (2018.01); *F21S 41/16* (2018.01); *F21S 41/663* (2018.01); *F21S 43/249* (2018.01); *F21Y 2115/10* (2016.08)

(56) References Cited

U.S. PATENT DOCUMENTS

| | | | | |
|---|---|---|---|---|
| 10,731,824 | B2 * | 8/2020 | Kawai | F21S 41/24 |
| 2014/0192547 | A1 | 7/2014 | Kumar et al. | |
| 2015/0124472 | A1 | 5/2015 | Wintzer et al. | |
| 2018/0087745 | A1 | 3/2018 | Gromfeld | |
| 2019/0154228 | A1 * | 5/2019 | Xiang | F21S 41/285 |
| 2019/0316749 | A1 * | 10/2019 | Zorn | F21S 41/365 |
| 2020/0080699 | A1 * | 3/2020 | Renaud | F21S 41/322 |
| 2022/0034470 | A1 * | 2/2022 | Chen | F21S 41/27 |
| 2022/0390080 | A1 * | 12/2022 | Iwasaki | F21S 41/147 |
| 2022/0412527 | A1 * | 12/2022 | Onoma | F21S 41/24 |

FOREIGN PATENT DOCUMENTS

| | | | |
|---|---|---|---|
| CN | 104864341 | A | 8/2015 |
| CN | 106287482 | A | 1/2017 |
| CN | 109630976 | A | 4/2019 |
| CN | 209893297 | U | 1/2020 |
| DE | 102013013995 | A1 | 7/2014 |
| DE | 102016006605 | A1 | 4/2017 |
| DE | 102019118051 | A1 | 1/2021 |
| JP | 2006164923 | A | 6/2006 |
| JP | 2006324013 | A | 11/2006 |
| JP | 2008532250 | A | 8/2008 |
| JP | 2018055986 | A | 4/2018 |
| JP | 2018538656 | A | 12/2018 |
| JP | 2019075232 | A | 5/2019 |
| KR | 20110052374 | A | 5/2011 |
| WO | 2018094431 | A1 | 5/2018 |

* cited by examiner

VEHICLE LAMP OPTICAL ELEMENT, VEHICLE LAMP MODULE, VEHICLE HEADLAMP AND VEHICLE

CROSS REFERENCE TO RELATED APPLICATIONS

The present application is a 35 U.S.C. § 371 national stage of PCT/CN2020/091591, which is titled Vehicle Lamp Optical Element, Vehicle Lamp Module, Vehicle Headlamp and Vehicle, and claims the benefits of Chinese patent application 201910488336.X, filed on Jun. 5, 2019, Chinese patent application 201910730411.9, filed on Aug. 8, 2019, and Chinese patent application 201910780214.8, filed on Aug. 22, 2019. All of PCT/CN2020/091591, CN201910488336.X, CN201910730411.9, and CN201910780214.8 are incorporated by reference into the present application as if fully set forth.

FIELD

The present disclosure relates to a vehicle lamp, in particular to a vehicle lamp optical element. In addition, the present disclosure further relates to a vehicle lamp module, a vehicle headlamp and a vehicle.

BACKGROUND

With the development of a vehicle technology, modeling of vehicle lamps is increasingly diversified, and in order to make the design of modeling of the vehicle lamps more flexible, by dispersing vehicle lamp illumination into a plurality of vehicle lamp illumination modules, a plurality of illumination areas are generated, and the light exiting parts of the vehicle lamp illumination modules are arranged in a certain arrangement, such as in a straight line, in a bent line, and in a curved line, according to the requirements of different vehicles for modeling of vehicle lamps. Specifically, as shown in FIG. 1, a vehicle lamp includes six vehicle lamp illumination modules M, one part of the six vehicle lamp illumination modules M are low beam vehicle lamp modules while the other part of the six vehicle lamp illumination modules M are high beam vehicle lamp modules, and the light exiting lenses of these vehicle lamp illumination modules M are arranged in a certain arrangement to show its characteristic modeling. However, if the lenses of the low beam vehicle lamp modules are lightened only in a low beam illumination mode, and the lenses of the high beam vehicle lamp modules are not lightened, the modeling effect of the multiple lenses cannot be emphasized, and thus, the aesthetic appearance of the overall vehicle is influenced. Therefore, it is required that the lenses of the high beam vehicle lamp modules are also lightened in the low beam illumination mode, but a high beam is not turned on to achieve an effect that all the lenses are lightened.

The Chinese utility model patent with the publication number of CN209893297U discloses a vehicle high beam module, which can realize that the high beam module also has auxiliary light ray emission in a low beam illumination mode, and a lens of the high beam module also emits light in the low beam illumination mode, so that the overall modeling beautiful degree of a vehicle lamp is improved. However, the optical components of the high beam module are independently arranged and need to be positioned and installed respectively, so that positioning and installation errors among the optical components are difficult to avoid, and the precision of the whole optical system is affected.

In view of the above-mentioned drawbacks in the prior art, there is a need to design a novel vehicle lamp optical element.

SUMMARY

The basic technical problem to be solved by the present disclosure is to provide a vehicle lamp optical element, and the vehicle lamp optical element is not only small in terms of size, but also high in optical precision, accurate in a light shape and easy to mount.

Further, the technical problem to be solved by the present disclosure is to provide a vehicle lamp module, and the vehicle lamp module is small in size, high in optical precision, few in constituent parts and low in positioning and mounting error.

In addition, the technical problem to be further solved by the present disclosure is to provide a vehicle headlamp, and the vehicle headlamp is small in size, high in optical precision, convenient to install and low in cost.

Finally, the technical problem to be solved by the present disclosure is to provide a vehicle, and the vehicle is provided with a small size vehicle headlamp, and is high in optical precision, convenient to install and low in cost.

In order to solve the technical problems, on one hand, the present disclosure provides a vehicle lamp optical element, comprising a light incoming part, a transmission part and a light exiting part which are sequentially arranged, wherein the light incoming part is provided with at least one light incoming structure, the rear end and the front end, in a light exiting direction, of the transmission part are respectively a light incoming end and a light exiting end of the transmission part; one end, facing away from the light exiting end of the transmission part, of the light exiting part forms a light exiting face, and the light exiting face is a curved face protruding forwards; wherein the distance between at least one set of opposite side faces of the transmission part gradually increases from the end approaching the light incoming end of the transmission part to the end approaching the light exiting end of the transmission part.

As a preferred embodiment of the present disclosure, the light incoming part further comprises a lens lightening structure located on one side of the light incoming part, and the lens lightening structure is capable of transmitting light rays entering the lens lightening structure to the transmission part by at least one-time reflection and then the light rays transmit to the light exiting part through the transmission part.

As a specific structural form of the present disclosure, the lens lightening structure comprises a first reflecting surface and a second reflecting surface, the first reflecting surface is capable of reflecting light rays entering the first reflecting surface to the second reflecting surface, and the second reflecting surface is capable of reflecting emergent light rays of the first reflecting surface to the transmission part.

Preferably, the lens lightening structure further comprises a lens lightening light incoming surface, a first light channel and a second light channel, the lens lightening light incoming surface corresponds to the first reflecting surface, the first reflecting surface reflects incident light rays of the lens lightening light incoming surface and then the reflected incident light rays transmit to the second reflecting surface through the first light channel, and emergent light rays of the second reflecting surface are transmitted to the transmission part through the second light channel.

More preferably, one end of the first light channel is connected to the first reflecting surface while the other end of the first light channel is connected to the second reflecting surface, and the cross sectional area of the first light channel gradually increases from the end approaching the first reflecting surface to the end approaching the second reflecting surface.

Further preferably, the first reflecting surface is located above the second reflecting surface, and the distance between the left side surface and the right side surface of the first light channel gradually increases from the end approaching the first reflecting surface to the end approaching the second reflecting surface.

Specifically, the first reflecting surface is a cambered surface protruding towards the lens lightening light incoming surface.

More specifically, the second reflecting surface is a cambered surface protruding towards a direction away from the first reflecting surface.

Further specifically, a reflection increasing layer is arranged on the first reflecting surface.

Still further specifically, the first reflecting surface is provided with skin textures or extinction teeth.

Typically, the lens lightening light incoming surface is a plane or a convex curved surface.

More typically, the lens lightening light incoming surface is provided with a light condensing structure.

As another preferred embodiment of the present disclosure, the cross sectional area of the transmission part gradually increases from a position approaching the light incoming end of the transmission part to a position approaching the light exiting end of the transmission part.

Preferably, the distance between the upper side surface and the lower side surface of the transmission part gradually increases from the end approaching the light incoming end of the transmission part to the end approaching the light exiting end of the transmission part.

More preferably, the distance between the left side surface and the right side surface of the transmission part gradually increases from the end approaching the light incoming end of the transmission part to the end approaching the light exiting end of the transmission part.

As another specific structural form of the present disclosure, the light incoming structures are arranged in a matrix manner, and the light incoming structures are arranged in at least one row.

Preferably, the ends, facing away from the transmission part, of the light incoming structures form light incoming surfaces, and the light incoming surfaces are curved surfaces or conical surfaces protruding backwards.

More preferably, the light incoming structures are configured to condense light rays.

As another preferred embodiment of the present disclosure, multiple light incoming structures are arranged, the light incoming structures are sequentially connected in a left-right direction, the ends, facing away from the transmission part, of the light incoming structures form light incoming surfaces, and the light incoming surfaces are curved surfaces protruding backwards.

Preferably, the left side surface and the right side surface of the transmission part extend forwards from the end approaching the light incoming end of the transmission part and then gradually draw close to a direction approaching the central axis of the transmission part.

More preferably, the width of the transmission part is smaller than that of the light exiting part, and the height of the transmission part is smaller than that of the light exiting part.

Specifically, the cross sectional area of the light exiting part gradually decreases from the end approaching the transmission part to the end away from the transmission part.

Further preferably, at least one side surface of the transmission part is provided with an extinction structure.

Specifically, the light incoming part, the transmission part and the light exiting part are integrally formed.

Typically, the outer surface of the light exiting face is provided with grid patterns or strip-shaped patterns.

A second aspect of the present disclosure provides a vehicle lamp module comprising a circuit board and the vehicle lamp optical element according to any one of the foregoing technical solutions, the circuit board is arranged behind the light incoming part of the vehicle lamp optical element, and high beam light sources corresponding to the light incoming structures are arranged on the circuit board.

Preferably, the vehicle lamp optical element is the vehicle lamp optical element including the lens lightening structure in any one of the foregoing technical solutions, the circuit board is provided with a lens lightening light source corresponding to the lens lightening structure, the high beam light sources and the lens lightening light source can be independently controlled to be turned on or off.

More preferably, multiple light incoming structures are arranged, the high beam light sources are in one-to-one correspondence with the light incoming structures, and each high beam light source can be independently controlled to be turned on or off.

A third aspect of the present disclosure provides a vehicle headlamp comprising the vehicle lamp module in any one of the foregoing technical solutions.

A fourth aspect of the present disclosure provides a vehicle comprising the vehicle headlamp according to the foregoing technical solution.

Through the basic technical solution of the present disclosure, the light incoming part, the transmission part and the light exiting part of the vehicle lamp optical element provided by the present disclosure are integrated, the integration degree is high, a primary optical element and a lens which are separated are not needed to be arranged, other unnecessary supporting devices do not need to be installed, the assembly relation is simple, furthermore, part manufacturing precision and optical system precision of the vehicle lamp optical element are improved, meanwhile, the size of the vehicle lamp optical element can be adaptively reduced when meeting the light distribution requirement condition, and integrated research is facilitated.

In a preferred mode of the present disclosure, when the vehicle lamp optical element is applied to a vehicle lamp, the lens lightening structure enables the light exiting face of the light exiting part to be lightened in a low beam illumination mode, and enables light rays emitted by the lens lightening light source to be diffused in the low beam illumination mode, so that a good visual effect of lightening the light exiting face is achieved, and meanwhile, the lightening brightness and range of the light exiting face do not affect low beam illumination of the vehicle lamp.

Further advantages as well as technical effects of preferred embodiments of the present disclosure will be further explained in the detailed description below.

BRIEF DESCRIPTION OF THE DRAWINGS

The following drawings, which serve to provide a further understanding of the present disclosure and constitute a part of this description, together with the detailed description below, serve to explain the present disclosure, but the scope of protection of the present disclosure is not limited to the following drawings and detailed description. In the drawings.

DESCRIPTION OF REFERENCE SIGNS

Figure 1:
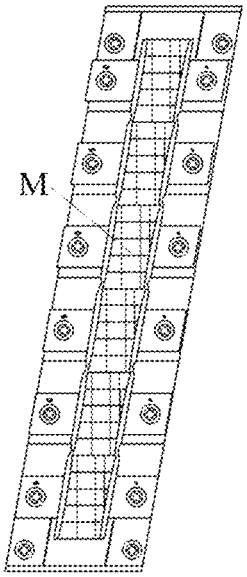
FIG. 1 is a structural schematic diagram of one embodiment of an arrangement mode of vehicle lamp illumination modules in the prior art.

1—light incoming part; 11—light incoming structure;
111—light incoming surface; 12—lens lightening structure;
121—lens lightening light incoming surface; 122—first reflecting surface;
123—second reflecting surface; 124—first light channel;
125—second light channel; 2—transmission part;
21—light incoming end of transmission part; 22—light exiting end of transmission part;
3—light exiting part; 31—light exiting face;
4—light condensing structure; 5—circuit board;
51—high beam light source; 52—lens lightening light source; and
M—vehicle lamp illumination module.

DETAILED DESCRIPTION OF THE EMBODIMENTS

Specific embodiments of the present disclosure are described in detail below with reference to the accompanying drawings. It should be understood that the specific embodiments described herein are for the purpose of illustrating and explaining the present disclosure only, and are not intended to limit the present disclosure.

Firstly, it should be noted that, in the following description, for clarity of explanation of the technical solution of the present disclosure, some directional terms, such as "front", "rear", "left", "right", "up", "down", and the like, have meanings by analogy with the direction indicated by the light transmission direction, for example, with an example of a vehicle lamp optical element, the end, close to high beam light sources 51, of the vehicle lamp optical element is a rear end, and the end, away from the high beam light sources 51, of the vehicle lamp optical element is a front end; it can also be understood that the end where the light incoming part 1 of the vehicle lamp optical element is located is the rear end, the end where the light exiting part 3 of the vehicle lamp optical element is located is the front end, and relative to the front-back direction of the vehicle lamp optical element, the direction represented by the left side and the right side of the vehicle lamp optical element is a left-right direction, and the direction represented by the upper side and the lower side of the vehicle lamp optical element is an up-down direction.

In the description of the present disclosure, it should be noted that, unless otherwise expressly stated or limited, the terms "installation" and "connection" are to be understood broadly, and for example, "connection" may be a fixed connection, a removable connection, or an integral connection; and may be a direct connection or an indirect connection through intermediary media, and may be an internal communication between two elements or an interaction between two elements. The specific meanings of the foregoing terms in the present disclosure can be understood according to specific situations by those of ordinary skill in the art. Moreover, the terms "first" and "second" are used for descriptive purposes only and are not to be construed as indicating or implying relative importance or implicitly indicating the number of technical features indicated, and therefore, a feature defined as "first" or "second" may expressly or implicitly include one or more of the described features.

It should also be noted that the distance between opposite side faces refers to the linear distance between two faces; a central axis is a virtual straight line which extends in the front-back direction of the vehicle lamp optical element and passes through the focal point of the light exiting part 3, and is also called an optical axis; and the light transmission direction is defined as the direction along the central axis and pointing from the light incoming part 1 to the light exiting part 3. The cross section of the vehicle lamp optical element is defined as the section obtained by cutting the vehicle lamp optical element by a plane perpendicular to the central axis, the longitudinal section of the vehicle lamp optical element is defined as the section obtained by cutting the vehicle lamp optical element by a vertical plane passing through the center axis, and the transverse section of the vehicle lamp optical element is defined as the section obtained by cutting the vehicle lamp optical element by a horizontal plane passing through the central axis; and the cross sectional area of the first light channel 124 is defined as the cross sectional area obtained by cutting the first light channel 124 by a plane perpendicular to the direction extending from the first reflecting surface 122 to the second reflecting surface 123.

Figure 28:
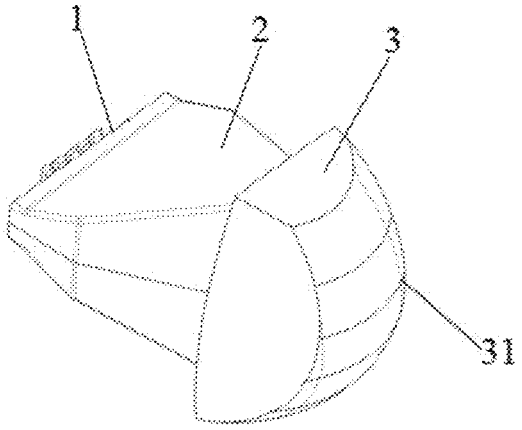
FIG. 28 is a first structural schematic diagram of a vehicle lamp optical element according to a sixth specific embodiment of the present disclosure.
Figure 29:
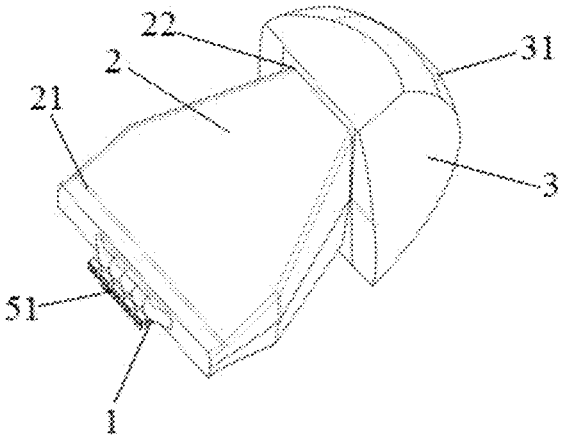
FIG. 29 is a second structural schematic diagram of the vehicle lamp optical element according to the sixth specific embodiment of the present disclosure.

The vehicle lamp optical element provided by the present disclosure, as shown in FIG. 2, FIG. 6 to FIG. 9, FIG. 18 and FIG. 19, FIG. 22 and FIG. 23, FIG. 25 and FIG. 26 as well as FIG. 28 and FIG. 29, includes a light incoming part 1, a transmission part 2 and a light exiting part 3 which are sequentially arranged, wherein the light incoming part 1 is provided with at least one light incoming structure 11, the rear end and the front end, in a light exiting direction, of the transmission part 2 are respectively a light incoming end 21 and a light exiting end 22 of the transmission part, one end, facing away from the light exiting end 22 of the transmission part, of the light exiting part 3 forms a light exiting face 31, and the light exiting face 31 is a curved face protruding forwards; and the distance between at least one set of opposite side faces of the transmission part 2 gradually increases from the end approaching the light incoming end 21 of the transmission part to the end approaching the light exiting end 22 of the transmission part.

According to the vehicle lamp optical element in the basic technical solution, the light incoming part 1, the transmission part 2 and the light exiting part 3 are integrated, the integration degree is high, a primary optical element and a secondary optical element which are separated are not needed to be arranged, other unnecessary supporting devices do not need to be installed, the assembly relation is simple, positioning and installation errors are greatly reduced, and the part manufacturing precision and the optical system precision of the vehicle lamp optical element are improved; at least one set of opposite side faces of the transmission part 2 is of the shape of a trapezoid which is gradually enlarged from back to front, so that light rays are convenient to collect; and the light exiting face 31 is arranged to be a curved face protruding forwards, and the light exiting part 3 refracts light rays through the light exiting face 31 to form high beam.

Figure 3:
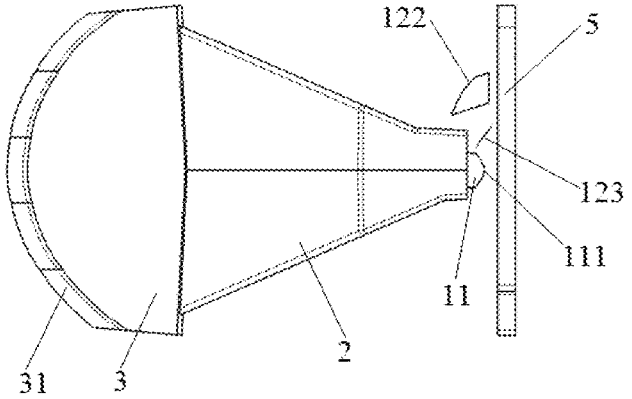
FIG. 3 is a structural schematic diagram of one specific embodiment of an assembly orientation of the vehicle lamp optical element shown in FIG. 2 and a circuit board.
Figure 4:
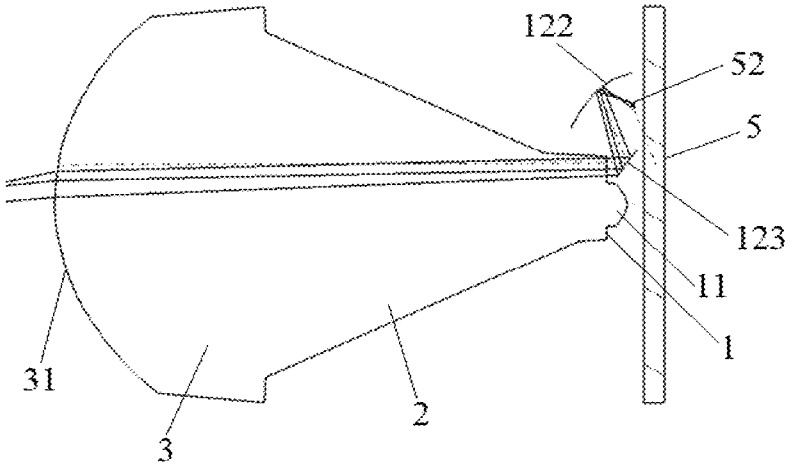
FIG. 4 is a light path diagram of a lens lightening structure shown in FIG. 3 formed in a longitudinal section of the vehicle lamp optical element.
Figure 5:
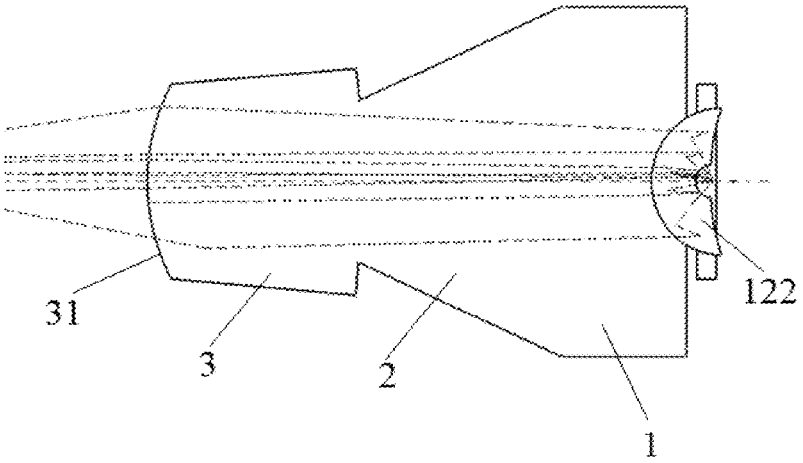
FIG. 5 is a light path diagram of the lens lightening structure shown in FIG. 3 formed in a transverse section of the vehicle lamp optical element.

When the vehicle lamp optical element is in a high beam illumination mode, light rays of light sources corresponding to the light incoming structures 11, namely high beam light sources 51 below, enter the light incoming part 1 through the light incoming structures 11, and are transmitted to the light exiting part 3 through the transmission part 2, and the light exiting part 3 refracts the light rays through the light exiting face 31 and then emits the light rays to form high beam. Wherein, the light exiting part 3 is a lens part of a high beam vehicle lamp module in the prior art, and correspondingly, in a low beam illumination mode, the high beam light sources 51 corresponding to the light incoming structures 11 are turned off, and at the moment, the vehicle lamp optical element is in a turned-off state, so that the modeling effect and the aesthetic degree of the vehicle lamp are influenced. Therefore, as a first preferred structural form of the basic technical solution, as shown in FIG. 2 to FIG. 19, the light incoming part 1 further includes a lens lightening structure 12 located on one side of the light incoming part 1, and the lens lightening structure 12 is capable of transmitting light rays entering the lens lightening structure 12 to the transmission part 2 by at least one-time reflection and then the light rays transmit to the light exiting part 3 through the transmission part 2. The lens lightening structure 12 and the light incoming part 1 share the transmission part 2 and the light exiting part 3, as shown in FIG. 3 to FIG. 5 as well as FIG. 16 and FIG. 17, in the low beam illumination mode, a light source corresponding to the lens lightening structure 12, namely a lens lightening light source 52 below, is in a turned-on state, and the lens lightening structure 12 reflects light rays entering the lens lightening structure 12 and the reflected light rays transmit to the light exiting part 3 through the transmission part 2. While the lens of the low beam vehicle lamp module is lightened by the low beam light source, the lens, namely the light exiting part 3, of the high beam vehicle lamp module is also lightened, in addition, the lens lightening structure 12 enables the lightening brightness and range of the lens of the high beam vehicle lamp module not to affect a low beam shape, only the visual effect that the lens of the high beam vehicle lamp module is lightened is achieved, and the appearance attractiveness of the vehicle lamp is improved. In the high beam illumination mode, the lens lightening light source 52 corresponding to the lens lightening structure 12 may be in a turned-on state or a turned-off state.

Figure 2:
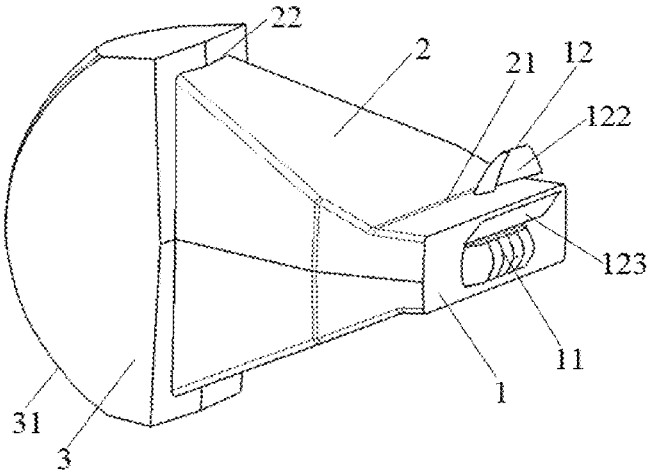
FIG. 2 is a structural schematic diagram of a vehicle lamp optical element according to a first specific embodiment of the present disclosure.
Figure 20:
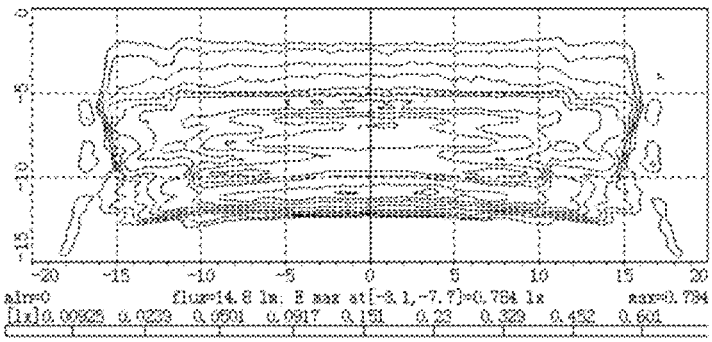
FIG. 20 is a schematic diagram of a projected light shape of the lens lightening light source formed by the vehicle lamp optical element shown in FIG. 2.

As a basic structural form of the foregoing lens lightening structure 12, as shown in FIG. 2, the lens lightening structure 12 includes a first reflecting surface 122 and a second reflecting surface 123, the first reflecting surface 122 is capable of reflecting light rays entering the first reflecting surface 122 to the second reflecting surface 123, and the second reflecting surface 123 is capable of reflecting emergent light rays of the first reflecting surface 122 to the transmission part 2. The first reflecting surface 122 and the second reflecting surface 123 may be integrally formed or separately and independently arranged, and the second reflecting surface 123 is preferably integrally formed with the light incoming part 1, so that the emergent light rays of the first reflecting surface 122 are transmitted to the transmission part 2 more efficiently, and meanwhile, the structure of the vehicle lamp optical element is more stable. At the moment, the light source corresponding to the lens lightening structure 12 is turned on and then projected by the light exiting part 3 to form a light shape as shown in FIG. 20.

Figure 6:
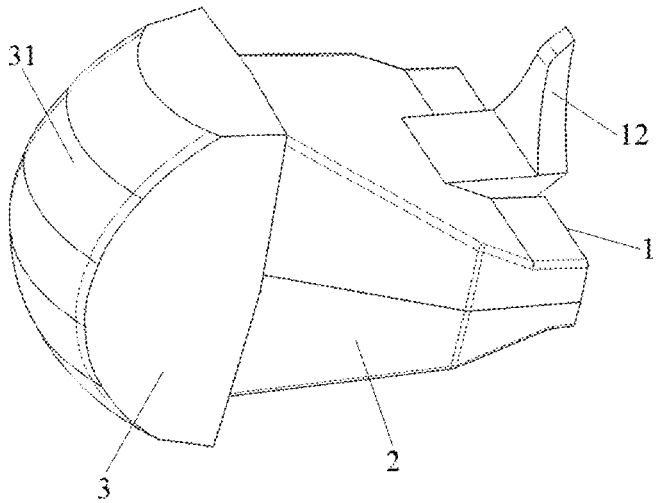
FIG. 6 is a first structural schematic diagram of a vehicle lamp optical element according to a second specific embodiment of the present disclosure.
Figure 7:
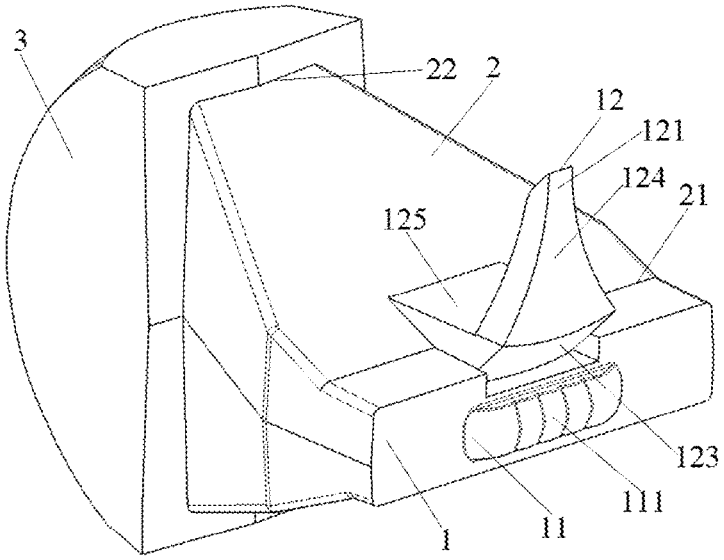
FIG. 7 is a second structural schematic diagram of the vehicle lamp optical element according to the second specific embodiment of the present disclosure.

As a specific structural form of the lens lightening structure 12, as shown in FIG. 6 and FIG. 7, the lens lightening structure 12 further includes a lens lightening light incoming surface 121, a first light channel 124 and a second light channel 125, the lens lightening light incoming surface 121 corresponds to the first reflecting surface 122, the first reflecting surface 122 reflects incident light rays of the lens lightening light incoming surface 121 and then the reflected incident light rays transmit to the second reflecting surface 123 through the first light channel 124, and emergent light rays of the second reflecting surface 123 are transmitted to the transmission part 2 through the second light channel 125. Due to arrangement of the first light channel 124 and the second light channel 125, the lens lightening structure 12 is more beneficial to collecting light rays, and the light rays imported by the lens lightening light incoming surface 121 are better guided to the transmission part 2.

Preferably, one end of the first light channel 124 is connected to the first reflecting surface 122 while the other end of the first light channel 124 is connected to the second reflecting surface 123, and the cross sectional area of the first light channel 124 gradually increases from the end approaching the first reflecting surface 122 to the end approaching the second reflecting surface 123. Based on the fact that the area of the second reflecting surface 123 is larger than that of the first reflecting surface 122, the first light channel 124 can be smoothly transitioned from the first reflecting surface 122 to the second reflecting surface 123 at the moment, and the collection efficiency of the first light channel 124 on light rays imported by the lens lightening light incoming surface 121 is further improved.

Figure 18:
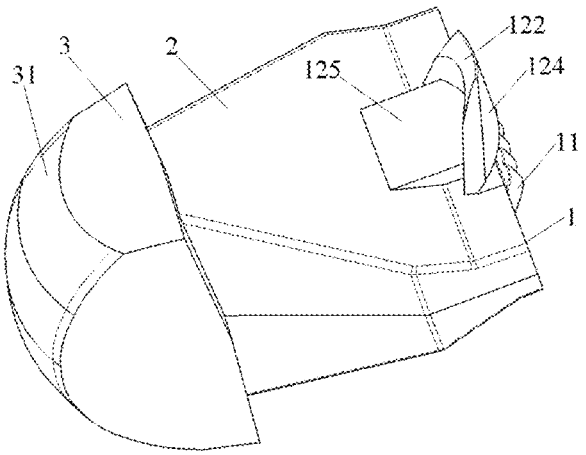
FIG. 18 is a first structural schematic diagram of a vehicle lamp optical element according to a third specific embodiment of the present disclosure.
Figure 19:
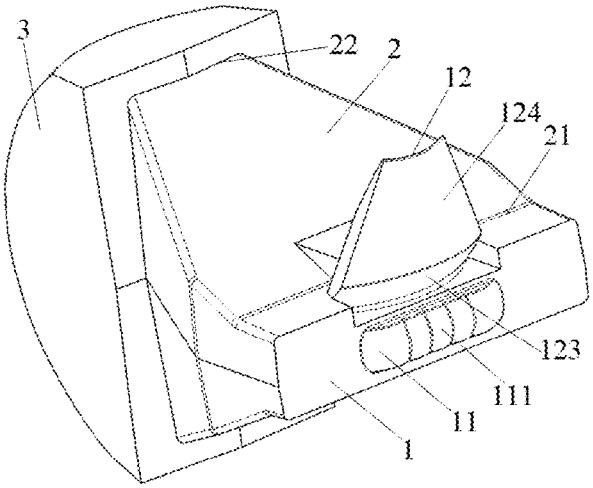
FIG. 19 is a second structural schematic diagram of the vehicle lamp optical element according to the third specific embodiment of the present disclosure.

Specifically, as shown in FIG. 6 and FIG. 7 as well as FIG. 18 and FIG. 19, the first reflecting surface 122 is located above the second reflecting surface 123, and the distance between the left side surface and the right side surface of the first light channel 124 gradually increases from the end approaching the first reflecting surface 122 to the end approaching the second reflecting surface 123. At the moment, the light rays of the lens lightening light source 52 enter the first reflecting surface 122 through the lens lightening light incoming surface 121, enter the first light channel 124 to be transmitted to the second reflecting surface 123 after being reflected by the first reflecting surface 122, then enter the second light channel 125 to be transmitted to the transmission part 2 after being reflected by the second reflecting surface 123, and finally are transmitted to the light exiting part 3 through the transmission part 2 to be emitted from the light exiting face 31. Therefore, the lens of the high beam vehicle lamp module, namely the light exiting part 3, emits light.

Figure 8:
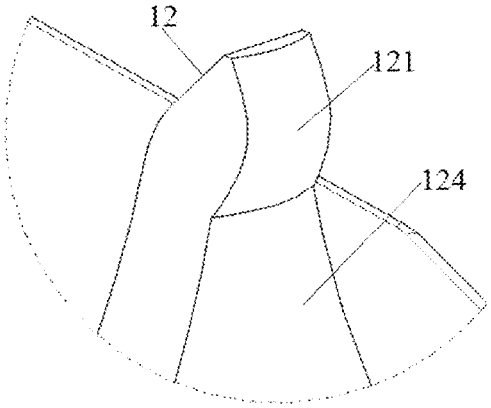
FIG. 8 is a structural schematic diagram of a first specific embodiment of a lens lightening light incoming surface in the vehicle lamp optical element shown in FIG. 7.
Figure 9:
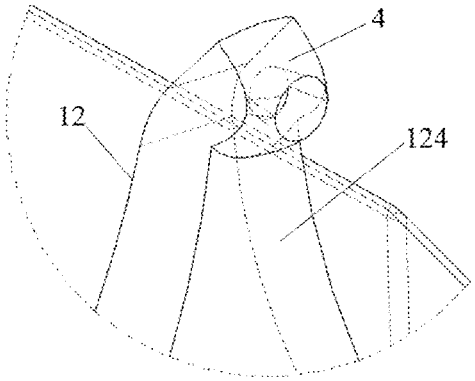
FIG. 9 is a structural schematic diagram of a second specific embodiment of the lens lightening light incoming surface in the vehicle lamp optical element shown in FIG. 7.
Figure 10:
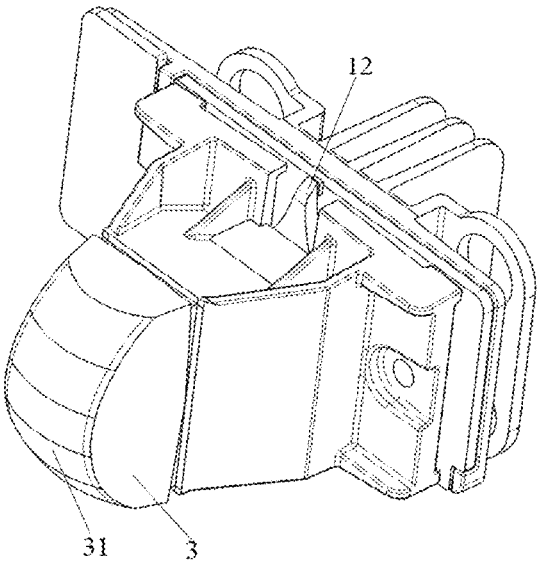
FIG. 10 is a structural schematic diagram of one specific embodiment of assembling the vehicle lamp optical element shown in FIG. 7 in a vehicle lamp module.
Figure 11:
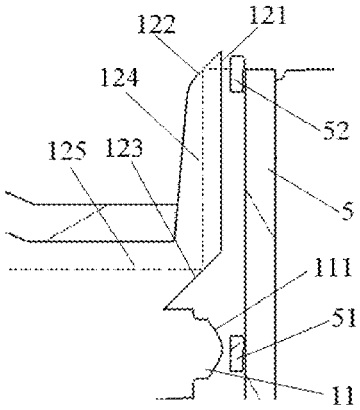
FIG. 11 is a structural schematic diagram of the lens lightening structure and the circuit board in the vehicle lamp module shown in FIG. 10.
Figure 12:
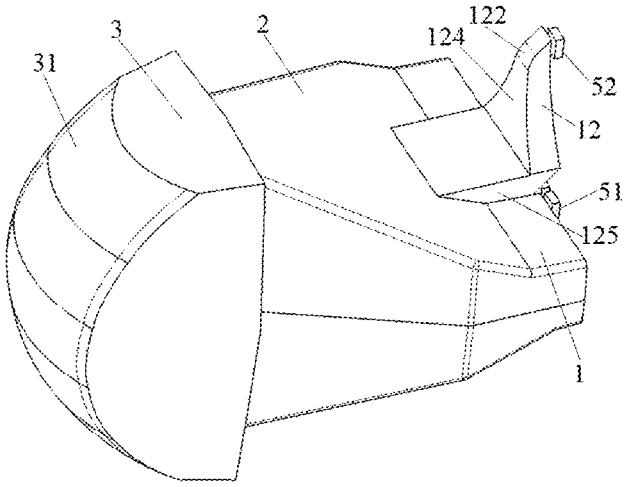
FIG. 12 is a first structural schematic diagram of the vehicle lamp optical element, high beam light sources and a lens lightening light source in the vehicle lamp module shown in FIG. 10.
Figure 13:
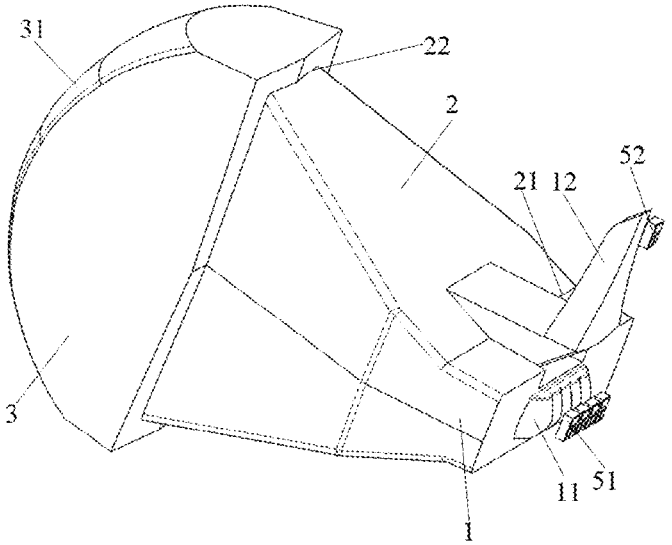
FIG. 13 is a second structural schematic diagram of the vehicle lamp optical element, the high beam light sources and the lens lightening light source in the vehicle lamp module shown in FIG. 10.
Figure 14:
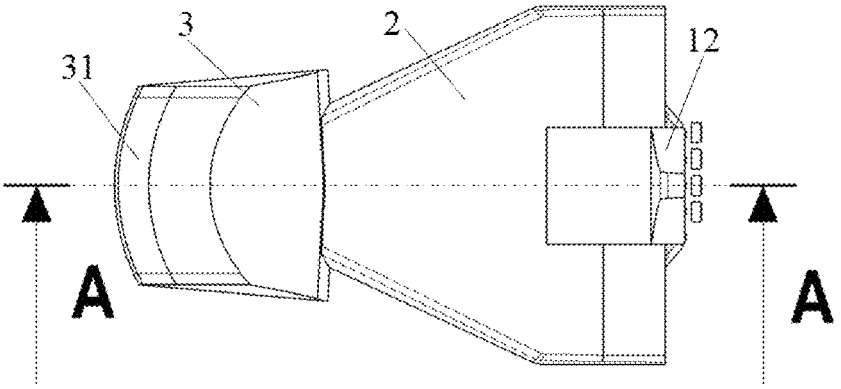
FIG. 14 is a top view of the vehicle lamp optical element, the high beam light sources and the lens lightening light source in the vehicle lamp module shown in FIG. 13.
Figure 15:
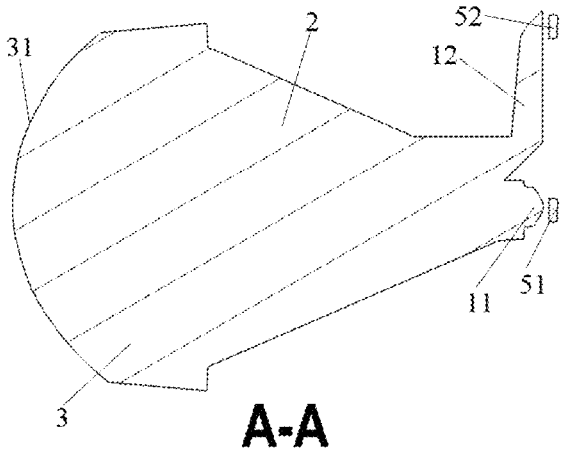
FIG. 15 is a cross sectional view taken along a line A-A in FIG. 14.

The lens lightening light incoming surface 121 is preferably arranged as a plane, and has a simple structure and good manufacturability, and in addition, the lens lightening light incoming surface 121 may also be a convex curved surface as shown in FIG. 8. Optionally, as shown in FIG. 9, a light condensing structure 4 is arranged at the lens lightening light incoming surface 121, and the light condensing structure 4 is provided with a concave cavity in the light incoming surface 121 which is in a convex curved surface as shown in FIG. 8, so that more incident light rays can be emitted to the first reflecting surface 122 through the light condensing structure 4, and the utilization rate of the light rays by the lens lightening structure 12 is improved.

The first reflecting surface 122 may be a plane or a cambered surface, or a combination of the plane and the cambered surface, and in order to make the first reflecting surface 122 and the second reflecting surface 123 be better matched, the first reflecting surface 122 is a cambered surface protruding towards the lens lightening light incoming surface 121 as a preferred form of the specific structure of the lens lightening structure 12, so that the reflected light rays of the first reflecting surface 122 can be diffused to the left side and the right side, and the shape of the emergent light reflected by the second reflecting surface 123 and projected by the light exiting part 3 is more uniform. At the moment, the included angle formed between the first reflecting surface 122 and the lens lightening light incoming surface 121 is preferably less than 90 degrees, so that the reflected light rays of the first reflecting surface 122 can be better diffused to the left side and the right side by utilizing the cambered surface structure of the first reflecting surface 122. Further preferably, skin textures or extinction teeth are further arranged on the first reflecting surface 122, so that the surface of the first reflecting surface 122 is rough or uneven, reflected light rays of the first reflecting surface 122 are more divergent, and the light shape of the reflected light rays projected by the light exiting part 3 is more uniform. Wherein, the extinction teeth are of tooth-shaped structures which are arranged on the first reflecting surface 122 and are concave and convex alternately.

Figure 21:
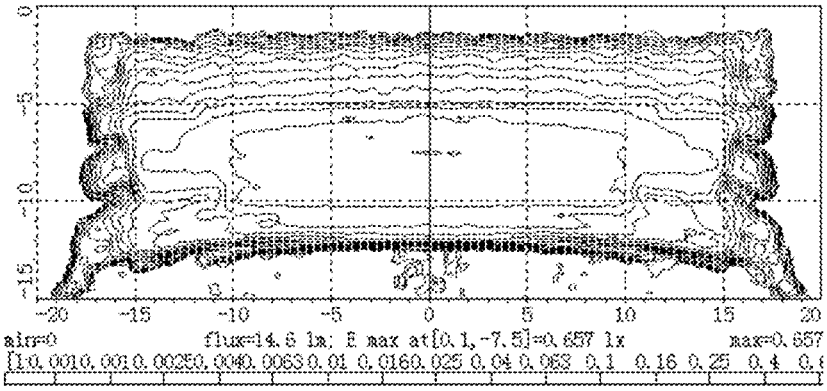
FIG. 21 is a schematic diagram of a projected light shape of the lens lightening light source formed by the vehicle lamp optical element shown in FIG. 18.

In order to improve the light ray reflection efficiency of the lens lightening structure 12, more preferably, a reflection increasing layer is arranged on the first reflecting surface 122 to improve the optical efficiency of the lens lightening structure 12, wherein the reflection increasing layer may be an aluminized layer, reflection increasing film or reflection increasing coating or the like. Further preferably, the second reflecting surface 123 is a cambered surface protruding towards the direction away from the first reflecting surface 122, so that the reflected light rays can enter the light exiting part 3 as much as possible after entering the transmission part 2 through the second light channel 125, the second reflecting surface 123 is prevented from reflecting the light rays to the area outside the light exiting part 3, the lightening effect of the light exiting part 3 is improved, and meanwhile, the width of the second reflecting surface 123 is reasonably set, so that the reflected light rays can be just reflected into the light exiting part 3, the luminous flux of the edge area of the light exiting part 3 is ensured, and the light exiting effect and the uniformity of the light shape of emergent light are also facilitated. At the moment, the light source corresponding to the lens lightening structure 12 is turned on and projected by the light exiting part 3 to form a light shape shown in FIG. 21, and the uniformity of the light shape is obviously improved compared with the basic structural form of the lens lightening structure 12 shown in FIG. 20. It should be noted that the second reflecting surface 123 may be arranged as a plane, a convex surface, or a concave surface structure in other form.

As a second preferred structural form of the basic technical solution of the vehicle lamp optical element, the cross sectional area of the transmission part 2 gradually increases from the position approaching the light incoming end 21 of the transmission part to the position approaching the light exiting end 22 of the transmission part. At the moment, the rear end of the vehicle lamp optical element is smaller while the front end of the vehicle lamp optical element is larger, the rear end of the vehicle lamp optical element is arranged to be the light incoming part 1, and the front end of the vehicle lamp optical element protrudes forwards to form a curved surface which is the light exiting face 31, so that light guided in through the light incoming part 1 can be better collected by the transmission part 2 and projected to the light exiting face 31; and meanwhile, under the premise of meeting the light exiting requirement of the light exiting face 31, the size of the vehicle lamp optical element may be adaptively reduced.

Figure 22:
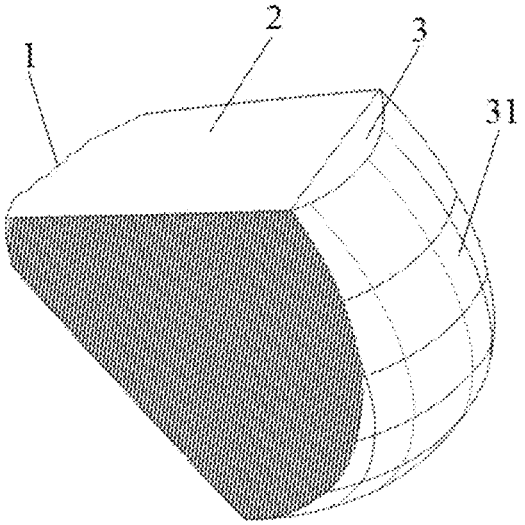
FIG. 22 is a first structural schematic diagram of a vehicle lamp optical element according to a fourth specific embodiment of the present disclosure.
Figure 25:
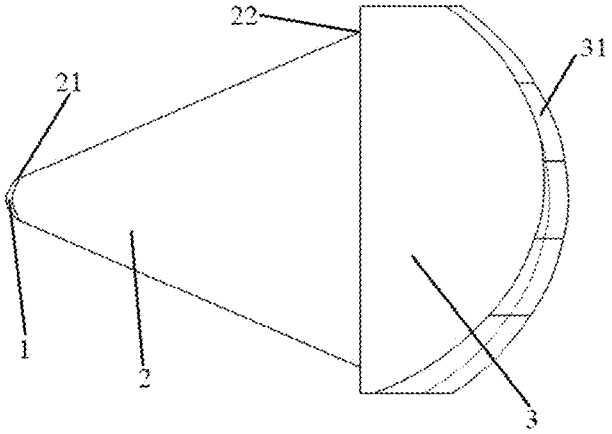
FIG. 25 is a first structural schematic diagram of a vehicle lamp optical element according to a fifth specific embodiment of the present disclosure.
Figure 26:
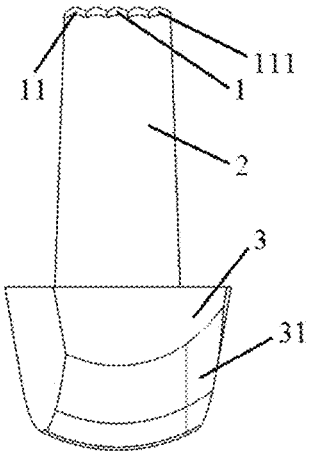
FIG. 26 is a second structural schematic diagram of the vehicle lamp optical element according to the fifth specific embodiment of the present disclosure.

More preferably, as shown in FIG. 22 and FIG. 25, the distance between the upper side surface and the lower side surface of the transmission part 2 gradually increases from the end approaching the light incoming end 21 of the transmission part to the end approaching the light exiting end 22 of the transmission part, that is, the length of the cross section of the transmission part 2 in the up-down direction gradually increases; and further, the distance between the left side surface and the right side surface of the transmission part 2 gradually increases from the end approaching the light incoming end 21 of the transmission part to the end approaching the light exiting end 22 of the transmission part, that is, the length of the cross section of the transmission part 2 in the left-right direction gradually increases. The length of the cross section of the transmission part 2 may gradually increase in the up-down direction, or the length of the cross section of the transmission part 2 may gradually increase in the left-right direction, or the length of the cross section of the transmission part 2 may gradually increase in the up-down direction and the left-right direction, and the transmission part 2 in the several shapes is favorable for collecting and transmitting light rays.

As a third preferred structural form of the basic technical solution of the vehicle lamp optical element, as shown in FIG. 6 and FIG. 7, FIG. 18 and FIG. 18 as well as FIG. 28 and FIG. 29, the left side surface and the right side surface of the transmission part 2 extend forwards from the end approaching the light incoming end 21 of the transmission part and then gradually draw close to a direction approaching the central axis of the transmission part 2 to form a low-reflectivity structure. When the light rays are transmitted in the transmission part 2, part of the light rays are usually directly emitted from the side surface of the transmission part 2 or reflected by the side surface of the transmission part 2 and then refracted by the light exiting face 31 of the light exiting part 3, so that a lot of stray light is formed, and the optical performance of the light shape of the vehicle lamp is influenced; and the transmission part 2 is arranged as the low-reflectivity structure, the incident angle of light rays entering the left side surface and the right side surface of the transmission part 2 is very small, so that the reflectivity of the left side surface and the right side surface of the transmission part 2 is very low, and stray light formed by reflecting the light rays entering the left side surface and the right side surface of the transmission part 2 to the light exiting face 31 of the light exiting part 3 is effectively reduced.

Figure 30:
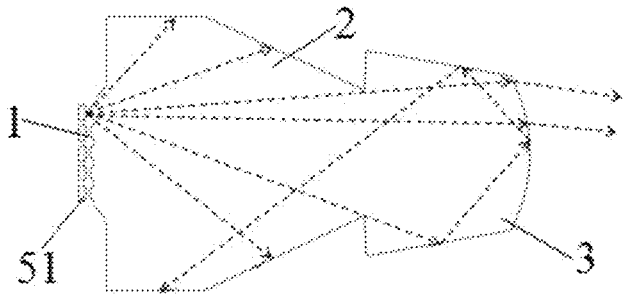
FIG. 30 is a light path diagram of a transverse section of the vehicle lamp optical element according to the sixth specific embodiment of the present disclosure.

As shown in FIG. 30, according to the transverse section of the transmission part 2 in the third preferred structural form of the vehicle lamp optical element, most of light rays of the corresponding high beam light sources 51 thereof are directly emitted from the light exiting face 31 of the light exiting part 3, part of the light rays are emitted to the side surface of the transmission part 2, the incident angles of the light rays entering the left side surface and the right side surface of the transmission part 2 are quite small, therefore, the side surface reflectivity is quite low, and light rays emitted to the left side surface and the right side surface of the transmission part 2 cannot be reflected into the light exiting part 3. Part of light rays are emitted to the side surface of the light exiting part 3, and the left (right) side surface of the light exiting part 3 is obliquely arranged, so that the light rays totally reflected therefrom to the light exiting face 31 can be totally reflected to the right (left) side surface of the light exiting part 3 and then totally reflected to the left (right) side surface of the transmission part 2 through the right (left) side surface. Due to the fact that the reflectivity of the left side surface and the right side surface of the transmission part 2 is quite low, basically no light rays are reflected therefrom to the light exiting face 31 to form stray light.

Figure 31:
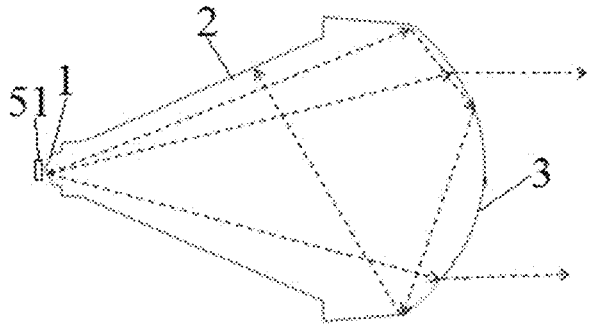
FIG. 31 is a light path diagram of a longitudinal section of the vehicle lamp optical element according to the sixth specific embodiment of the present disclosure.

Further, in the third preferred structural form of the vehicle lamp optical element, as shown in FIG. 2 and FIG. 28, the transmission part 2 may also be arranged such that the distance between the upper side surface and the lower side surface of the transmission part 2 gradually increases from the end approaching the light incoming end 21 of the transmission part to the end approaching the light exiting end 22 of the transmission part, so that the light ray collection effect is further enhanced, and the light transmission efficiency is improved. As shown in FIG. 31, the transmission part 2 with the gradually increased length in the up-down direction directly emits most of the light rays entering by the light incoming part 1 from the light exiting face 31 of the light exiting part 3, and a small part of the light rays entering by the light incoming part 1 are emitted to the side surface of the light exiting part 3.

Further preferably, as shown in FIG. 4 and FIG. 5, FIG. 25 and FIG. 26 as well as FIG. 30 and FIG. 31, the cross sectional area of the light exiting part 3 gradually decreases from the end approaching the transmission part 2 to the end away from the transmission part 2, so that the totally-reflected light rays can be totally reflected to the opposite side surface of the light exiting part 3 through the light exiting face 31 of the light exiting part 3 and finally totally reflected to the side surface of the transmission part 2. Therefore, no light rays of the vehicle lamp optical element are emitted from the side surface of the light exiting part 3, or reflected by the side surface and then refracted from the light exiting face 31 of the light exiting part 3, and stray light is basically eliminated.

However, by the three preferred structural forms of the vehicle lamp optical element, stray light refracted to the outside by the side surface of the transmission part 12 cannot be effectively eliminated, and therefore, an extinction structure may be arranged on at least one side surface of the transmission part 2. The extinction structure specifically may be an extinction coating or extinction patterns, wherein the extinction patterns enable the surface of the side wall of the transmission part 2 to be rough or uneven, so that light directly emitted from the side wall of the transmission part 2 or stray light projected by the light exiting part 3 after being reflected by the side wall of the transmission part 2 is reduced, and the light condensing capacity of the transmission part 2 is improved, and exemplarily, the extinction patterns may be skin textures arranged on the side surface of the transmission part 2 or tooth-shaped structures which are concave and convex alternately; and the extinction coating may prevent light rays from being emitted to the outside and reduce reflection and transmission of light rays from the side surface of the transmission part 2, specifically, the extinction coating may be coated with a matt black paint, or the surface may be provided with skin textures and coated with common black paint concurrently.

Figure 27:
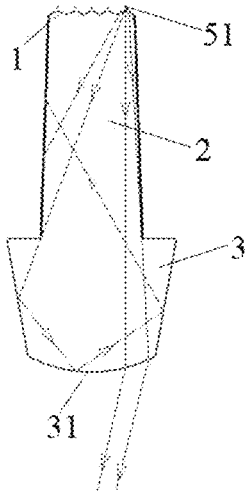
FIG. 27 is a light path diagram of the vehicle lamp optical element according to the fifth specific embodiment of the present disclosure.

As a specific structural form of the three preferred structural forms of the vehicle lamp optical element, the width of the transmission part 2 is smaller than that of the light exiting part 3, and the height of the transmission part 2 is smaller than that of the light exiting part 3. According to the structure, more light rays entering the light exiting part 3 through the transmission part 2 may be emitted to the light exiting face 31 of the light exiting part 3 and projected through the light exiting face 31, the amount of the light rays emitted to the side surface of the light exiting part 3 from the transmission part 2 is reduced, the incident angle of the light rays capable of irradiating to the side surface of the light exiting part 3 is larger and is enough to be larger than the critical angle of total reflection, and thus, total reflection is formed to avoid that light rays emitted by the corresponding high beam light sources 51 are emitted from the side surface of the light exiting part 3 or are reflected by the side surface of the light exiting part 3 and then refracted by the light exiting face 31 of the light exiting part 3 to form stray light, specifically, referring to the light path diagrams in FIG. 27 and FIG. 30, by taking the high beam light sources 51 located on the leftmost side as an example, in the light rays emitted by the high beam light sources 51, a first part is directly emitted to the light exiting face 31 of the light exiting part 3 and is projected by the light exiting face 31 of the light exiting part 3 to form a vehicle lamp light shape; a second part of the light rays emitted to the side surface of the transmission part 2 are cut off by the side surface provided with the extinction structure and cannot be emitted or reflected from the side surface of the transmission part 2; a third part of the light rays emitted to the right side surface of the light exiting part 3 may be totally reflected to the light exiting face 31 of the light exiting part 3, then be totally reflected to the left side surface of the light exiting part 3 by the light exiting face 31 of the light exiting part 3, and finally be totally reflected to the right side surface of the transmission part 2 by the left side surface of the light exiting part 3 to be cut off; referring to the light path diagram in FIG. 31, the height of the transmission part 2 in the up-down direction is smaller than that of the light exiting part 3 in the up-down direction, so that light rays emitted by the corresponding high beam light sources 51 can be directly transmitted to the light exiting part 3 and refracted out, or even if some light rays are emitted to the side surface of the light exiting part 3, the light rays may be totally reflected to the light exiting face 31 of the light exiting part 3, and the light rays are totally reflected to the opposite side surfaces of the light exiting part 3 by the light exiting face 31 of the light exiting part 3, and finally are totally reflected to the side surface of the transmission part 2 by the opposite side surfaces of the light exiting part 3 to be cut off.

As shown in FIG. 2, FIG. 7, FIG. 23, FIG. 26 and FIG. 29, the light incoming structures 11 in the vehicle lamp optical element of the present disclosure are arranged in a matrix manner, and the light incoming structures 11 are arranged in at least one row. Optionally, one row, two rows or multiple rows of light incoming structures 11 are arranged on the light incoming part 1, and the light incoming structures 11 are sequentially connected or arranged at intervals on the light incoming part 1; and when the light incoming structures 11 are arranged in one row on the light incoming part 1, the light incoming structures 11 may be arranged left and right or up and down on the light incoming part 1. Further preferably, the light incoming structures 11 are configured to condense light rays.

Figure 23:
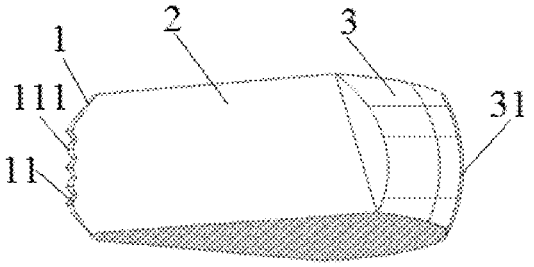
FIG. 23 is a second structural schematic diagram of the vehicle lamp optical element according to the fourth specific embodiment of the present disclosure.
Figure 24:
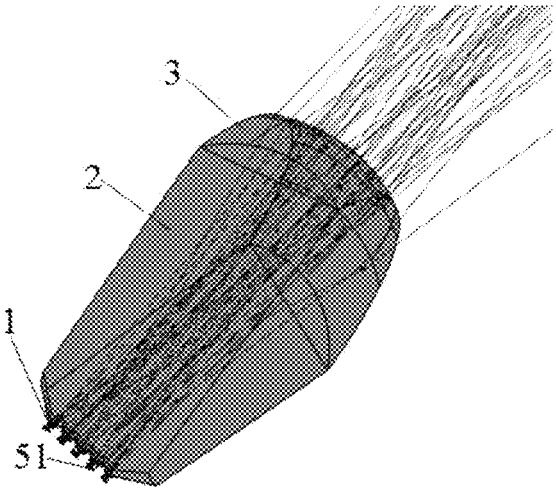
FIG. 24 is a light path diagram of the vehicle lamp optical element according to the fourth specific embodiment of the present disclosure.

Specifically, the ends, facing away from the transmission part 2, of the light incoming structures 11 form light incoming surfaces 111, and the light incoming surfaces 111 are curved surfaces or conical surfaces protruding backwards, so that light rays can be conveniently condensed. As shown in FIG. 23, a row of five light incoming structures 11 are arranged on the light incoming part 1, the light incoming surfaces 111 of the light incoming structures 11 are rectangular pyramids protruding backwards, the tops of the rectangular pyramids protrude towards the direction of the high beam light sources 51, the side surfaces of the rectangular pyramids may be planes or curved surfaces, the bottom edges of every two adjacent rectangular pyramids are connected, or every two adjacent rectangular pyramids are arranged at intervals. In the present embodiment, the top of each rectangular pyramid corresponds to the mounting position of the corresponding high beam light source 51, the light emitting center of each high beam light source 51 corresponds to the top of the corresponding rectangular pyramid, and the high beam light sources 51 are preferably placed at the focal points of the light incoming structures 11.

It needs to be noted that no matter which structural form is adopted by the light incoming structures 11, the effects of the light incoming structures 11 meet the following two requirements: on one hand, the light incoming structures 11 can better condense and collimate incident light rays; and on the other hand, a biconvex lens or a structural form similar to the biconvex lens can be formed by matching the light incoming structures 11 with the light exiting face 31 protruding forwards, the incident light rays can be better collected, collimated and then projected forwards, and an ideal design light shape can be formed.

Preferably, the light incoming part 1, the transmission part 2 and the light exiting part 3 are integrally formed and may be made of transparent plastics, silica gel, glass and the like, and the plastics may be PMMA or PC. The light incoming part 1, the transmission part 2 and the light exiting part 3 of the vehicle lamp optical element in the present disclosure are simple in structure, and can meet the technological requirement of integral forming. The vehicle lamp optical element is integrally formed, so that the relative position accuracy of the light incoming part 1 and the light exiting part 3 is guaranteed, the mounting structure and the mounting process are simplified, and furthermore, the manufacturing cost is reduced.

Further preferably, the outer surface of the light exiting face 31 is provided with grid patterns or strip-shaped patterns, so that the emergent light rays are more diffused and more uniform, and dimming can be facilitated. The grid structure of the light exiting face 31 may be formed by connecting a plurality of convex curved surfaces, the diffusion direction of light is controlled by adjusting the size of grids, generally, the larger the area of a single grid is, the more obvious the diffusion of light is, the proper grid area may be selected for treatment according to actual needs, uniformity of the emergent light shape is improved, and dispersion is weakened.

According to the second preferred structural form and the third preferred structural form of the vehicle lamp optical element, the lens lightening structure 12 in the first preferred structural form may be additionally arranged, and thus, the technical effect that the vehicle lamp optical element can lighten the lens to enable the lens to emit light when the vehicle lamp is in a low beam illumination mode is achieved.

The size of the vehicle lamp optical element of the present disclosure can be adaptively reduced when meeting the light distribution requirement condition, and the vehicle lamp optical element may be arranged on a vehicle high beam module, and is particularly suitable for a high beam module with a narrow and small lens light exiting face, so that the modeling design of the vehicle lamp is more diversified. In addition, it should be noted that a complete light distribution pattern of a high beam vehicle lamp can be formed by adopting the foregoing vehicle lamp optical element, optical elements such as a secondary convex lens are not needed, of course, an inner lens may be arranged between the vehicle lamp optical element and an outer lens of the vehicle lamp to meet the requirements of vehicle lamp modeling and the like, and the inner lens may be a common equal-wall-thickness plastic piece, only for presenting the required modeling, and can also be a light distribution plastic piece with a light distribution function on the back surface.

A second aspect of the present disclosure also provides a vehicle lamp module, as shown in FIG. 3 to FIG. 5, FIG. 10 to FIG. 17, FIG. 24 and FIG. 27 to FIG. 31, the vehicle lamp module includes a circuit board 5 and the vehicle lamp optical element according to any one of the foregoing technical solutions, the circuit board 5 is arranged behind the light incoming part 1 of the vehicle lamp optical element, and high beam light sources 51 corresponding to the light incoming structures 11 are arranged on the circuit board 5.

In the vehicle lamp module, light rays emitted by the high beam light sources 51 enter the light incoming part 1 of the vehicle lamp optical element from the light incoming structures 11, are transmitted to the light exiting part 3 through the transmission part 2, and finally are refracted by the light exiting face 31 to be emitted to form high beam. The vehicle lamp module is further provided with a radiator, a radiating support and other structures which are used for providing supporting and radiating functions for the circuit board 5 and the vehicle lamp optical element.

Based on the vehicle lamp optical element of the present disclosure, only a light source, the vehicle lamp optical element and a necessary supporting device need to be arranged in each vehicle lamp module, so that the vehicle lamp module is simple and compact in structure, low in cost and simple in assembly relation, and the overall dimension of the vehicle lamp module may also be adaptively reduced. Meanwhile, under the condition that the part manufacturing precision of the vehicle lamp optical element meets the requirement, the optical system precision of the vehicle lamp module is only related to the assembly precision between the vehicle lamp optical element and the light source, so that the dimming difficulty is small, and the error of the optical system precision of the vehicle lamp module is small.

As a preferred structural form of the vehicle lamp module, as shown in FIG. 11 to FIG. 15, a vehicle lamp optical element in the vehicle lamp module adopts the vehicle lamp optical element provided with the lens lightening structure 12 in any one of the technical solutions, and meanwhile, the circuit board 5 is provided with a lens lightening light source 52 corresponding to the lens lightening structure 12. The high beam light sources 51 and the lens lightening light source 52 can be independently controlled to be turned on or off. The high beam light sources 51 and the lens lightening light source 52 may specifically adopt LED light sources or laser light sources.

More preferably, the multiple light incoming structures 11 are arranged, the high beam light sources 51 are in one-to-one correspondence with the light incoming structures 11, and each high beam light source 51 can be independently controlled to be turned on or off.

Figure 16:
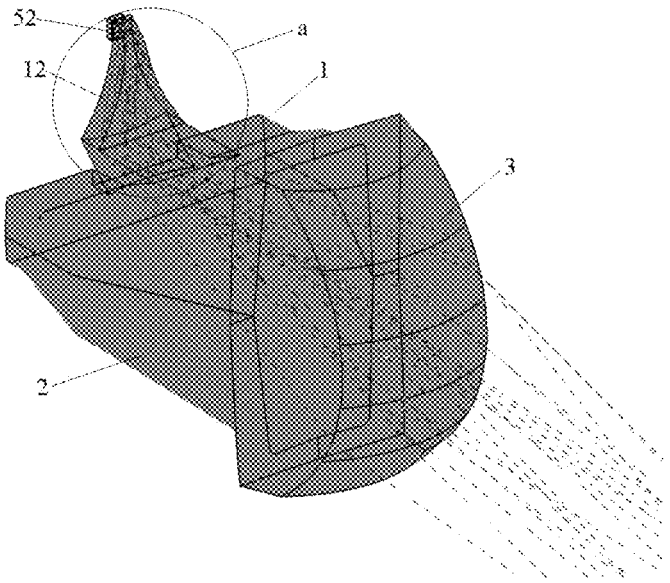
FIG. 16 is a light path diagram of the vehicle lamp optical element shown in FIG. 7.
Figure 17:
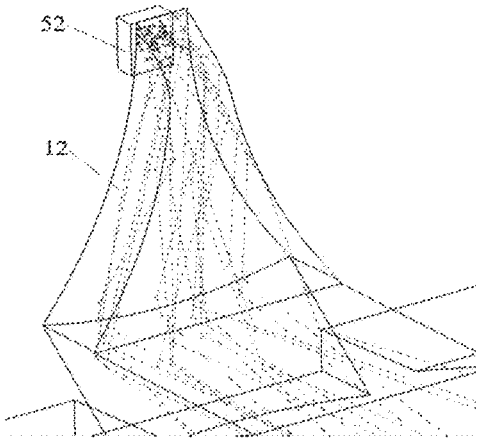
FIG. 17 is an enlarged partial view of a part a in FIG. 16.

In a preferred structural form of the vehicle lamp module, as shown in FIG. 12 to FIG. 15, the lens lightening light source 52 is arranged above the high beam light sources 51, each high beam light source 51 and the lens lightening light source 52 can be independently controlled to be turned on or off, and light rays emitted by the lens lightening light source 52 are projected by the vehicle lamp optical element to achieve a lens lightening effect. The light path of the light rays of the lens lightening light source 52 in the vehicle lamp optical element is shown in FIG. 16 and FIG. 17. Further, the lens lightening light source 52 may be configured as a brightness-adjustable light source, in the low beam illumination mode, the lens lightening light source 52 is a normally-on light source, and the multiple high beam light sources 51 may be arranged in a matrix manner and turned on in the high beam illumination mode.

It should be noted that the relationship between the high beam light sources 51 and the lens lightening light source 52 is not strictly limited to an up-down relative position relationship, and may be a left-right relative position relationship, or a relative position relationship in which the lens lightening light source 52 is arranged at a certain inclined angle with respect to the high beam light sources 51.

A third aspect of the present disclosure further provides a vehicle headlamp including the vehicle lamp module according to any one of the technical solutions. The multiple vehicle lamp modules are arranged, and the multiple vehicle lamp modules are integrally or dispersedly arranged in the vehicle headlamp. Optionally, the vehicle lamp modules are distributed in the vehicle headlamp according to longitudinal, transverse or inclined arrangement.

Figure 32:
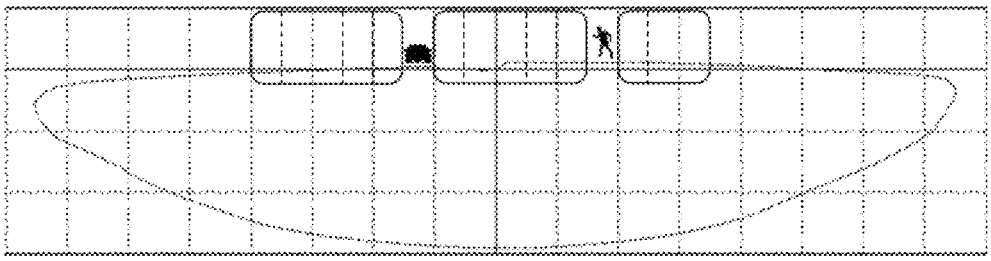
FIG. 32 is a light shape diagram of one specific embodiment of a vehicle headlamp of the present disclosure.

The multiple vehicle lamp modules are arranged in the vehicle headlamp to jointly form a Matrix headlamp, the illumination effect of the Matrix headlamp is shown in FIG. 32, the Matrix headlamp is composed of a plurality of illumination units, when obstacles such as other vehicles or pedestrians appear on the driving route of a vehicle, the high beam shape of the vehicle headlamp is adjusted, the high beam light source 51 corresponding to the illumination unit where the obstacle is located is turned off, therefore, the area where the illumination unit is located is darkened, other road users are prevented from dazzling, and the driving safety is improved.

A fourth aspect of the present disclosure also provides a vehicle including the vehicle headlamp according to the technical solution. Therefore, the vehicle at least has all the beneficial effects brought by the technical solutions of the embodiments of the vehicle lamp optical element, the vehicle lamp module and the vehicle headlamp. The constitution and operation of the vehicle according to the embodiments of the present disclosure may be understood and easily implemented by those skilled in the art, and therefore will not be described in detail.

As can be seen from the above description, the vehicle lamp optical element of the present disclosure includes the light incoming part 1, the transmission part 2 and the light exiting part 3 which are sequentially arranged, wherein the light incoming part 1 is provided with at least one light incoming structure 11, and at least one set of opposite side faces of the transmission part 2 are of the shape of a trapezoid which is gradually enlarged from back to front, so that light rays can be conveniently collected; and the light exiting face 31 is arranged to be a curved surface protruding forwards, and the light exiting part 3 refracts light rays through the light exiting face 31 to form high beam. The vehicle lamp optical element is high in integration degree, a primary optical element and a lens which are separated are not needed to be arranged, other unnecessary supporting devices do not need to be installed, and the assembly relation is simple, furthermore, the part manufacturing precision and the optical system precision of the vehicle lamp optical element are improved, meanwhile, the size of the vehicle lamp optical element can be adaptively reduced when meeting the light distribution requirement condition, and integrated research is facilitated.

In a preferred mode of the present disclosure, when the vehicle lamp optical element is applied to a vehicle lamp, the lens lightening structure 12 enables the light exiting face 31 of the light exiting part 3 to be lightened in a low beam illumination mode, and enables light rays emitted by the lens lightening light source 52 to be diffused in the low beam illumination mode, so that a good visual effect of lightening the light exiting face 31 is achieved; and meanwhile, the lightening brightness and range of the light exiting face 31 do not affect low beam illumination of the vehicle lamp.

The preferred embodiments of the present disclosure have been described in detail with reference to the accompanying drawings, however, the present disclosure is not limited to the specific details of the above embodiments, and various simple modifications may be made to the technical solution of the present disclosure within the technical idea range of the present disclosure, and these simple modifications all fall within the scope of protection of the present disclosure.

It should be noted that the various specific technical features described in the above embodiments may be combined in any suitable manner without contradicting, and in order to avoid unnecessary repetition, the present disclosure does not separately describe various possible combinations.

In addition, any combination of the various embodiments of the present disclosure can be made, and as long as it does not depart from the idea of the present disclosure, it should be regarded as the content disclosed by the present disclosure.

The invention claimed is:

1. A vehicle lamp optical element, comprising a light incoming part, a transmission part and a light exiting part which are sequentially arranged, wherein: the light incoming part is provided with multiple light incoming structures, the light incoming structures are sequentially connected in a left-right direction, the ends facing away from the transmission part, of the light incoming structures form light incoming surfaces, and the light incoming surfaces are curved surfaces protruding backwards; a rear end and a front end, in a light exiting direction, of the transmission part are respectively a light incoming end and a light exiting end of the transmission part; one end, facing away from the light exiting end of the transmission part, of the light exiting part forms a light exiting face, and the light exiting face is a curved face protruding forwards;

wherein the distance between at least one set of opposite side faces of the transmission part gradually increases from the end approaching the light incoming end of the transmission part to the end approaching the light exiting end of the transmission part, a left side surface and a right side surface of the transmission part extend forwards from the end approaching the light incoming end of the transmission part, and then gradually draw close to a direction approaching a central axis of the transmission part; the light incoming part, the transmission part and the light exiting part are integrally formed, the light incoming part further comprises a lens lightening structure located on one side of the light incoming part, and the lens lightening structure is capable of transmitting light rays entering the lens lightening structure to the transmission part by at least one-time reflection and then the light rays transmit to the light exiting part through the transmission part.

2. The vehicle lamp optical element according to claim 1, wherein the lens lightening structure comprises a first reflecting surface and a second reflecting surface, the first reflecting surface is capable of reflecting light rays entering the first reflecting surface to the second reflecting surface, and the second reflecting surface is capable of reflecting emergent light rays of the first reflecting surface to the transmission part.

3. The vehicle lamp optical element according to claim 2, wherein the lens lightening structure further comprises a lens lightening light incoming surface, a first light channel and a second light channel, the lens lightening light incoming surface corresponds to the first reflecting surface, the first reflecting surface reflects incident light rays of the lens lightening light incoming surface and then the reflected incident light rays transmit to the second reflecting surface through the first light channel, and emergent light rays of the second reflecting surface are transmitted to the transmission part through the second light channel.

4. The vehicle lamp optical element according to claim 3, wherein one end of the first light channel is connected to the first reflecting surface while the other end of the first light channel is connected to the second reflecting surface, and a cross sectional area of the first light channel gradually increases from the end approaching the first reflecting surface to the end approaching the second reflecting surface.

5. The vehicle lamp optical element according to claim 4, wherein the first reflecting surface is located above the second reflecting surface, and the distance between the left side surface and the right side surface of the first light channel gradually increases from the end approaching the first reflecting surface to the end approaching the second reflecting surface.

6. The vehicle lamp optical element according to claim 3, wherein (1) the first reflecting surface is a cambered surface protruding towards the lens lengthening light incoming surface; or (2) the second reflecting surface is a cambered surface protruding towards a direction away from the first reflecting surface; or (3) the first reflecting surface is a cambered surface protruding towards the lens lengthening light incoming surface and the second reflecting surface is a cambered surface protruding towards a direction away from the first reflecting surface.

7. The vehicle lamp optical element according to claim 3, wherein the lens lightening light incoming surface is a plane or a convex curved surface, or the lens lightening light incoming surface is provided with a light condensing structure.

8. The vehicle lamp optical element according to claim 2, wherein one of a reflection increasing layer, skin textures and extinction teeth is arranged on the first reflecting surface.

9. The vehicle lamp optical element according to claim 1, wherein the cross sectional area of the transmission part gradually increases from a position approaching the light incoming end of the transmission part to a position approaching the light exiting end of the transmission part.

10. The vehicle lamp optical element according to claim 9, wherein the distance between an upper side surface and a lower side surface of the transmission part gradually increases from the end approaching the light incoming end of the transmission part to the end approaching the light exiting end of the transmission part.

11. The vehicle lamp optical element according to claim 9, wherein the light incoming structures are arranged in a matrix manner, and the light incoming structures are arranged in at least one row; or the light incoming structures are configured to condense light rays.

12. The vehicle lamp optical element according to claim 1, wherein the width of the transmission part is smaller than that of the light exiting part, and the height of the transmission part is smaller than that of the light exiting part.

13. The vehicle lamp optical element according to claim 1, wherein a cross sectional area of the light exiting part gradually decreases from the end approaching the transmission part to the end away from the transmission part.

14. The vehicle lamp optical element according to claim 1, wherein (1) at least one side surface of the transmission part is provided with an extinction structure; or (2) the outer surface of the light exiting face is provided with grid patterns or strip-shaped patterns; or (3) at least one side surface of the transmission part is provided with an extinction structure and the outer surface of the light exiting face is provided with grid patterns or strip-shaped patterns.

15. A vehicle lamp module, comprising a circuit board and the vehicle lamp optical element according to claim 1, wherein the circuit board is arranged behind the light incoming part of the vehicle lamp optical element, and high beam light sources corresponding to the light incoming structures and a lens lightening light source corresponding to the lens lightening structure are arranged on the circuit board, and the high beam light sources and the lens lightening light source can be independently controlled to be turned on or off.

16. The vehicle lamp module according to claim 15, wherein multiple light incoming structures are arranged, the high beam light sources are in one-to-one correspondence with the light incoming structures, and each high beam light source can be independently controlled to be turned on or off.

17. A vehicle headlamp, comprising the vehicle lamp module according to claim 15.

* * * * *